US005187827A

United States Patent [19]

Wei

[11] Patent Number: 5,187,827

[45] Date of Patent: Feb. 23, 1993

[54] MULTIPURPOSE CLEANING DEVICE

[76] Inventor: Chih-Yen Wei, No. 225, She Chung Street, Shihlin District, Taipei, Taiwan

[21] Appl. No.: 657,394

[22] Filed: Feb. 19, 1991

[51] Int. Cl.[5] ..... A46B 13/06

[52] U.S. Cl. ..... 15/22.1; 15/97.1; 128/37; 128/62 R

[58] Field of Search ..... 15/22.1, 97.1; 128/62 R, 37, 47, 50, 53

[56] References Cited

U.S. PATENT DOCUMENTS 3,910,265 10/1975 Coleman ..... 15/22.1
3,992,744 11/1976 Fassler ..... 15/22.1
4,458,676 7/1984 Pileggi ..... 15/22.1
4,640,462 2/1987 Stearns ..... 15/22.1

*Primary Examiner*—Edward L. Roberts
*Attorney, Agent, or Firm*—Morton J. Rosenberg; David I. Klein

[57] ABSTRACT

A multipurpose cleaning device, which utilizes water pressure to drive a rotary wheel which is heavier on one side and has teeth that slope in one direction. Elastic elements are provided to reinforce the vibration caused by the rotary wheel when the rotary wheel is forced to rotate by the water pressure. A control plate is set between a fixed wheel and a contact plate to control flow rate of water so as to regulate the strength of vibration. Different cleaning elements are adapted to be releasably attached to the device according to different cleaning purposes.

4 Claims, 4 Drawing Sheets

MULTIPURPOSE CLEANING DEVICE

BACKGROUND OF THE INVENTION

The present invention relates to multipurpose cleaning devices, and more particularly to a multipurpose cleaning device which can vibrate to achieve a better cleaning effect and can be alternatively attached with a variety of cleaning heads according to different cleaning purposes.

Regular handy cleaning devices are generally respectively designed for specific purposes. For example, the wires of a brush for cleaning clothes are generally made from a flexible plastic material while the wires of a brush for cleaning kitchen utensils are generally made from metal or rigid plastic materials. Further, sponge or foamed plastic is commonly used for manufacturing a cleaning device for cleaning the body. Therefore different cleaning device may be required for different purpose. The present invention is designed to provide a cleaning device which can be conveniently adjusted to suit different cleaning purposes.

SUMMARY OF THE INVENTION

According to the present invention, there is provided a multipurpose cleaning device which utilizes water pressure to drive a rotary wheel. The rotary wheel is heavier on one side so that it will vibrate when it is forced by water pressure to rotate. Elastic elements are provided to reinforce the vibration. A control plate is set between a fixed wheel and a contact plate to control the flow rate of water so as to regulate the strength of vibration. Different cleaning elements can be releasably attached to the device according to different cleaning purposes.

The multipurpose cleaning device of the present invention provides various features outlined hereinafter.

1. It is driven by the flow of water without consuming any power supply;
2. It produces vibration to achieve better cleaning effect;
3. Different cleaning elements can be used according to different cleaning purposes;
4. It conveniently permits changing of the cleaning elements according to different cleaning purposes;
5. Detergent or soapy water is conveniently supplied through press-button control; and
6. The handle is orthopedically engineered to fit the shape of a user's palm for comfort.

BRIEF DESCRIPTION OF THE DRAWINGS

The present invention will now be described by way of example with reference to the annexed drawings, in which.

DETAILED DESCRIPTION OF THE PREFERRED EMBODIMENT

Figures 1, 1A:
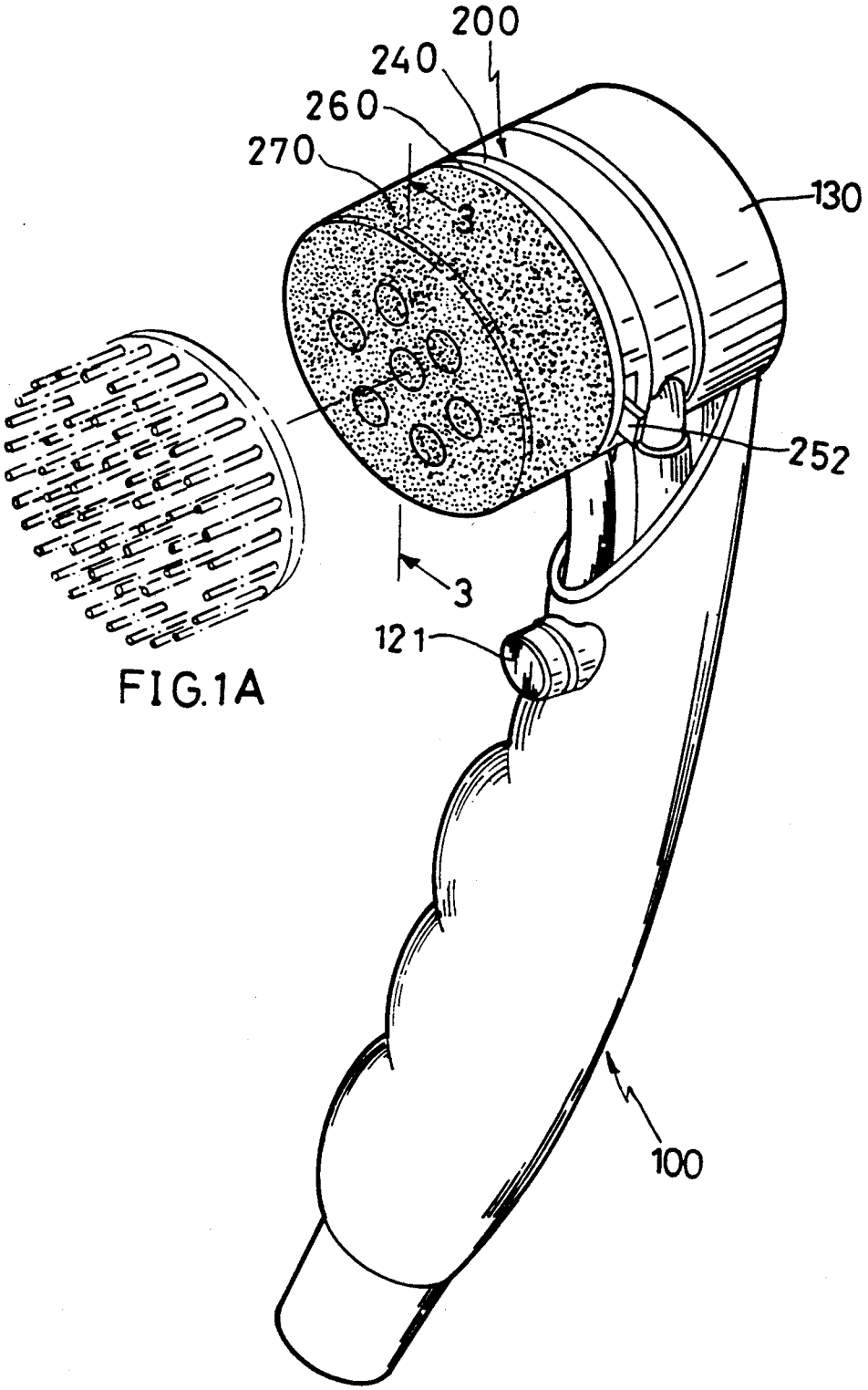
FIG. 1 is a perspective view of tile preferred embodiment of the cleaning device of the present invention.
FIG. 1A is a perspective view of an alternative cleaning element of the cleaning device of the present invention.
Figure 2:
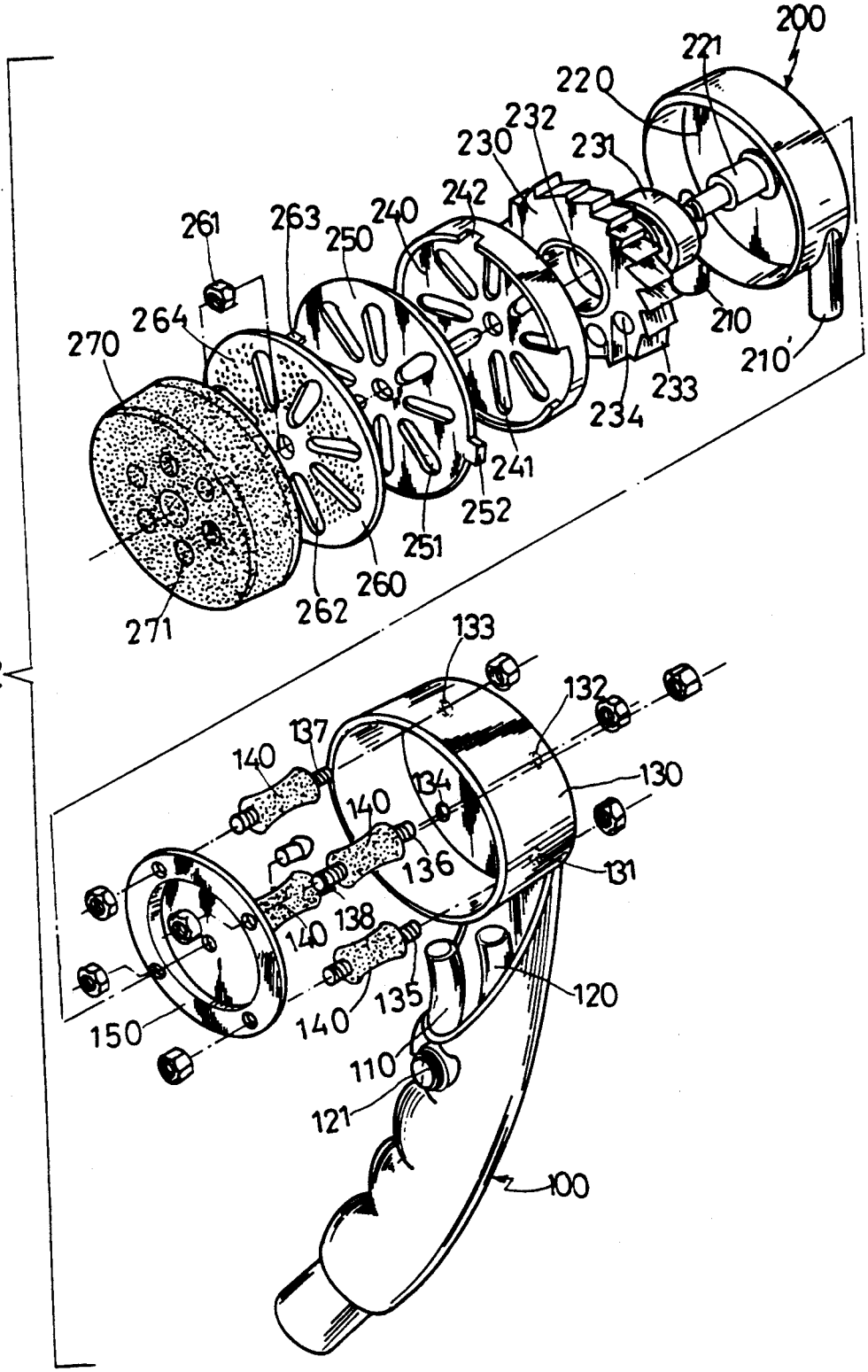
FIG. 2 is a perspective dismantled view of the preferred embodiment of the present invention.
Figure 3:
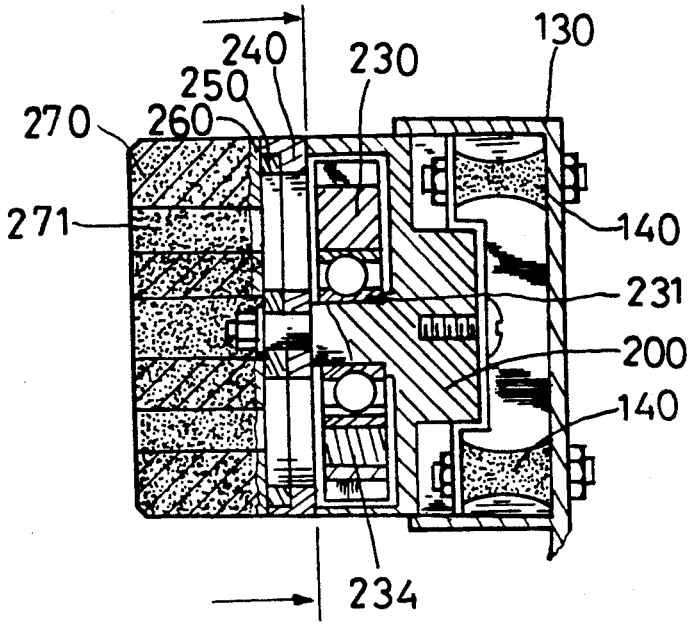
FIG. 3 is a sectional view taken on line 3—3 of FIG. 1.
Figure 4:
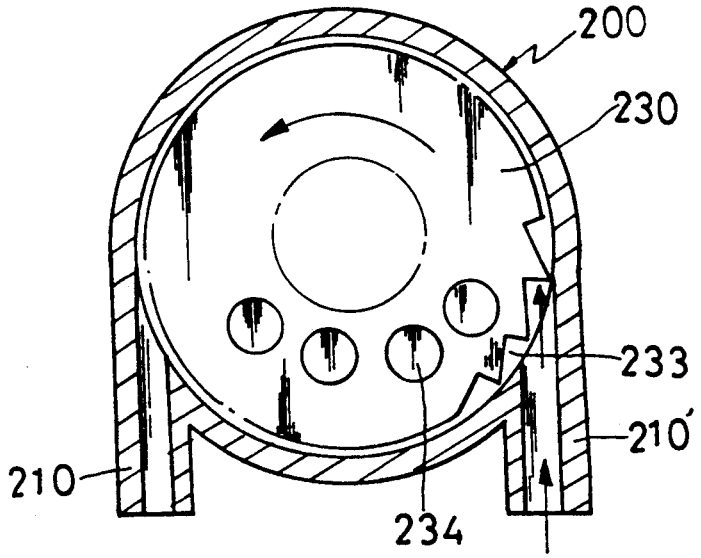
FIG. 4 is a sectional view taken on line 4—4 of FIG. 3.
Figure 5:
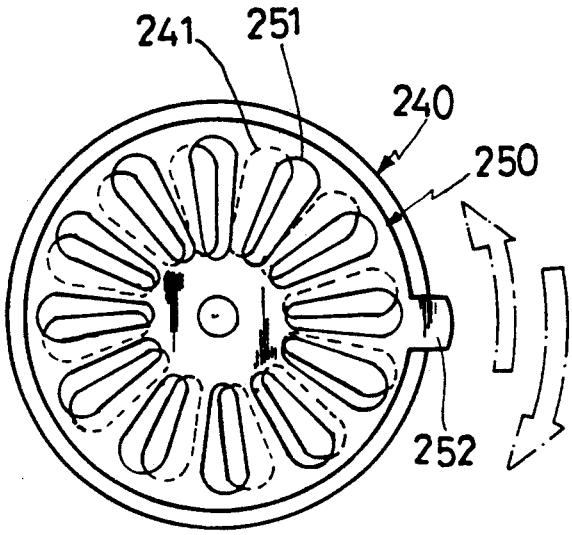
FIG. 5 is a schematic drawing showing the control of the control plate to regulate flow rate.

Referring to FIGS. 1-5, handle 100 is a hollow structure having set therein a water supply tube 110 and a detergent supply tube 120. The water supply tube 110 has one end connected to a water inlet connector 210 formed on a back seat member 200 and an opposite end connected to a water tap (not shown). The detergent supply tube 120 has one end connected to a detergent inlet connector 210' formed on back seat member 200 and an opposite end connected to a detergent container set inside the handle 100 (not shown). By means of the control of a control button 121, soapy water or detergent is sucked from the detergent container into the receiving trough 220 which is defined in the back seat member 200.

The handle 100 has a holder plate 130 at the top end thereof with four bolt holes 131, 132, 133 and 134 equidistantly spaced therein for fastening four elastic elements 140 by screws 135, 136, 137 and 138 to resiliently support a protective plate 150. After the protective plate 150 is connected to the holder plate 130 of the handle 100 by the elastic elements and the screws, it is then secured to the rear of back seat member 200. The back seat member 200 has a stepped post 221 upstanding from the center of the receiving trough 220 thereof for mounting a toothed wheel 230 which has a center hole 232 with a bearing 231 set therein, a fixed wheel 240, a control plate 250 and a contact plate 260, in that order, which are fixedly secured in position by a lock nut 261. The toothed wheel 230 has teeth 233 that slope in one direction, and a counter-weight 234 at one side. Because of the effect of counter-weight 234, the toothed wheel 230 will vibrate when it is forced to rotate. The counter-weight 234 has a hollow portion at one end and a solid portion at an opposite end so as to centralize the gravity of the toothed wheel 230 at one side, causing the toothed wheel 230 to vibrate during its rotary motion. The fixed wheel 240 has a plurality of elongated slots 241 radially piercing therethrough. Therefore, flow of water which comes from the water supply tube 110 and which forces the toothed wheel 230 to rotate (see FIG. 4) is permitted to flow through the elongated slots 241 without passing through the periphery of the fixed wheel 240. The control plate 250 is retained to rotate in the fixed wheel 240, having a plurality of elongated slots 251 respectively made thereon at locations corresponding to the elongated slots 241 on the fixed wheel 240 and a knob 252 (see FIG. 5) peripherally projecting through the fixed wheel 240. By means of shifting the knob 252, the elongated slots 251 of the control plate 250 are controlled to align with or deviated from the elongated slots 241 of the fixed wheel 240 so as to shut off flow of water or let it pass therethrough. When flow of water is allowed to pass through the elongated slots 241 and 251, the device of the present invention will be vibrated by water pressure. The contact plate 260 also has a plurality of elongated slots 262 radially piercing therethrough through which water is allowed to flow out, and a locating block 263 at the edge thereof which engages a retaining notch 242 on the fixed wheel 240 so that the contact plate 260 is immovably retained to the fixed wheel 240 permitting the elongated slots 262 to respectively align with the elongated slots 241 of the fixed wheel 240. Therefore, by means of the control of the control plate 250, flow of water from the water supply tube 110 is allowed to flow out of the contact plate 260. The contact plate 260 has a front contact face 264 for releasably mounting a cleaning element 270 by velcro fastening means. In the embodiment shown, cleaning element 270 has a plurality of small holes 271 for passing therethrough of flow of water.

Other cleaning elements 270, in accordance with the present invention, may be utilized, as shown in FIG. 1A. Such cleaning elements may comprise a sponge, metal wires or plastic bristles or hairs for different cleaning purposes. In an alternate form of the present invention, a cleaning element 270 may be directly attached to the fixed wheel 240 to retain the control plate 250 therebetween without using the contact plate 260.

Operation of the present invention is quite simple as outlined hereinafter. Pressing on the control button 121 causes detergent or soapy water to eject out of the detergent supply tube 120 for cleaning. Adjusting the control plate 250 through the knob 252 causes cleaning water and detergent or soapy water to mix and flow out of the device through the cleaning element 270. When flow of water passes through the toothed wheel 2,30, the toothed wheel 230 is caused to vibrate. Because the back seat member 200 is secured to the protective plate 150 which is resiliently supported by the elastic elements 140, vibration of the toothed wheel 230 causes the parts of the device to shake back and forth, and therefore, the cleaning element 270 is moved to rub against the surface of the object to be cleaned to remove debris thereform.

Although described with respect to a preferred embodiment of the invention, it is to be understood that various changes and/or modification may be made to the present invention withoiut departing from the spirit thereof.

I claim:

1. A multipurpose cleaning device comprising:

a handle assembly including (1) a hollow handle having a water supply tube adapted to connect to a supply of water and a detergent supply tube adapted to connect to a supply of detergent extending therethrough, (2) a holder plate carried by a top portion of said handle, and (3) a protective plate coupled to said holder plate by a plurality of elastic elements extending therebetween for enabling displacement of said protective plate relative to said holder plate;

a seat assembly coupled to said handle assembly, said seat assembly including a seat member affixed to said protective plate, said seat member having a receiving trough formed in a center portion thereof and a stepped post projecting therefrom, said seat member having (1)a detergent inlet connector in fluid communication with said receiving trough for connecting said detergent supply tube to said receiving trough, and (2) a water inlet connector in fluid communication with said receiving trough for connecting said water supply tube to said receiving trough, said seat assembly further including (1) a rotor disposed within said receiving trough and rotatably mounted to said stepped post by a bearing unit for rotation about an axis thereof, said rotor having a non uniform weight distribution relative to said rotational axis and having a plurality of teeth formed about a perimeter edge thereof, whereby said rotor is driven to rotate responsive to water flowing through said water inlet connector striking said teeth, said nonuniform weight distribution inducing a vibration of said seat assembly responsive to said rotaion of said rotor, (2) a fixed wheel coupled to said stepped post for substantially enclosing said receiving trough, said fixed wheel having a plurality of elongated first radial slots formed therein through which a mixture of water and detergent can flow from said receiving chamber, (3) a control plate pivotally coupled to said stepped post overlying said fixed wheel, said control plate having a plurality of elongated second radial slots formed therein, and (4) a contact plate mounted on said stepped post overlying said control plate and being fixedly coupled to said fixed wheel, said contact plate having a plurality of elongated third radial slots formed therein, each of said plurality of elongated third radial slots being in substantial alignment with a respective one of said plurality of elongated first radial slots;

a cleaning element having a first side coupled to said contact plate for use in cleaning operations, said cleanig element having a plurality of small holes formed therein for passage of said mixture therethrough; and wherein said control plate has a control knob defined by a tab formed thereon, said tab extending through a slotted opening formed in a peripheral portion of said fixed wheel for rotatively displacing said control plate relative to said fixed wheel to vary alignment between said plurality of elongated second radial slots and said elongated first radial slots respectively, thereby controlling flow of said mixture passed therethrough into said cleaning element and a resulting intensity of said vibration.

2. The cleaning device of claim 1, wherein said cleaning element is releasably coupled to said contact plate.

3. The cleaning device of claim 2, wherein said cleaning element is defined by a sponge.

4. The cleaning device of claim 2, wherein said cleaning element is defined by a brush.

* * * * *